US010533454B2

(12) United States Patent
Synnott et al.

(10) Patent No.: US 10,533,454 B2
(45) Date of Patent: Jan. 14, 2020

(54) TURBINE SHROUD COOLING

(71) Applicant: PRATT & WHITNEY CANADA CORP., Longueuil (CA)

(72) Inventors: Remy Synnott, St-Jean-sur-Richelieu (CA); Mohammed Ennacer, St-Hubert (CA); Chris Pater, Longueuil (CA); Denis Blouin, Ste-Julie (CA); Kapila Jain, Kirkland (CA); Farough Mohammadi, Montreal (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 59 days.

(21) Appl. No.: 15/840,498

(22) Filed: Dec. 13, 2017

(65) Prior Publication Data

US 2019/0178103 A1 Jun. 13, 2019

(51) Int. Cl.

| | |
|---|---|
| ***F01D 25/12*** | (2006.01) |
| ***F01D 5/18*** | (2006.01) |
| ***F01D 9/02*** | (2006.01) |
| ***F01D 5/22*** | (2006.01) |
| ***F01D 5/08*** | (2006.01) |

(52) U.S. Cl.

CPC ..... *F01D 25/12* (2013.01); *F01D 5/081* (2013.01); *F01D 5/185* (2013.01); *F01D 5/225* (2013.01); *F01D 9/023* (2013.01); *F05D 2260/201* (2013.01); *F05D 2260/205* (2013.01)

(58) Field of Classification Search

CPC ..... F01D 11/08; F01D 25/24; F01D 25/12; F01D 25/08

See application file for complete search history.

(56) References Cited

U.S. PATENT DOCUMENTS

| | | | |
|---|---|---|---|
| 3,831,258 | A | 8/1974 | Elbert et al. |
| 4,137,619 | A | 2/1979 | Beltran et al. |
| 4,383,854 | A | 5/1983 | Dembowski et al. |
| 4,604,780 | A | 8/1986 | Metcalfe |
| 4,616,976 | A | 10/1986 | Lings |
| 4,871,621 | A | 10/1989 | Bagley et al. |
| 5,010,050 | A | 4/1991 | Wullenweber et al. |
| 5,130,084 | A | 7/1992 | Matheny et al. |
| 5,486,090 | A | 1/1996 | Thompson |
| 5,488,825 | A | 2/1996 | Davis |
| 5,538,393 | A | 7/1996 | Thompson |
| 5,553,999 | A | 9/1996 | Proctor et al. |
| 5,574,957 | A | 11/1996 | Barnard et al. |
| 5,772,748 | A | 6/1998 | Hubbard |
| 5,933,699 | A | 8/1999 | Ritter et al. |
| 5,950,063 | A | 9/1999 | Hens et al. |
| 6,102,656 | A | 8/2000 | Nissley et al. |

(Continued)

*Primary Examiner* — Richard A Edgar

(74) *Attorney, Agent, or Firm* — Norton Rose Fulbright Canada L.L.P.

(57) ABSTRACT

A turbine shroud segment comprises a body having an upstream end portion and a downstream end portion relative to a flow of gases through the gas path. A core cavity is defined in the body and extends axially from the upstream end portion to the downstream end portion. A plurality of cooling inlets is defined in the upstream end portion of the body for feeding coolant in the core cavity. A plurality of cooling outlets is defined in the downstream end portion of the body for discharging coolant from the core cavity. Pedestals are provided in the core cavity.

12 Claims, 4 Drawing Sheets

(56) References Cited

U.S. PATENT DOCUMENTS

| | | | |
|---|---|---|---|
| 6,196,799 | B1 | 3/2001 | Fukue |
| 6,217,282 | B1 | 4/2001 | Stanka |
| 6,350,404 | B1 | 2/2002 | Li et al. |
| 6,547,210 | B1 | 4/2003 | Marx et al. |
| 6,595,750 | B2 | 7/2003 | Parneix |
| 6,679,680 | B2 | 1/2004 | Um et al. |
| 6,709,771 | B2 | 3/2004 | Allister |
| 6,776,955 | B1 | 8/2004 | Lim et al. |
| 6,857,848 | B2 | 2/2005 | Fokine et al. |
| 6,874,562 | B2 | 4/2005 | Knott et al. |
| 6,910,854 | B2 | 6/2005 | Joslin |
| 6,939,505 | B2 | 9/2005 | Musso et al. |
| 6,974,308 | B2 | 12/2005 | Halfmann |
| 7,007,488 | B2 | 3/2006 | Orlando |
| 7,029,228 | B2 | 4/2006 | Chan et al. |
| 7,052,241 | B2 | 5/2006 | Decker |
| 7,114,920 | B2 | 10/2006 | Synnott |
| 7,128,522 | B2 | 10/2006 | Jutras |
| 7,175,387 | B2 | 2/2007 | Kreis et al. |
| 7,217,081 | B2 | 5/2007 | Scheurlen et al. |
| 7,234,920 | B2 | 6/2007 | Imbourg et al. |
| 7,306,424 | B2 | 12/2007 | Romanov |
| 7,407,622 | B2 | 8/2008 | Voice et al. |
| 7,513,040 | B2 | 4/2009 | Cunha |
| 7,517,189 | B2 | 4/2009 | Camus |
| 7,621,719 | B2 | 11/2009 | Lutjen |
| 7,625,178 | B2 | 12/2009 | Morris |
| 7,687,021 | B2 | 3/2010 | Imbourg et al. |
| 7,785,067 | B2 | 8/2010 | Lee |
| 7,857,581 | B2 | 12/2010 | Mons et al. |
| 7,875,340 | B2 | 1/2011 | Cho et al. |
| 8,246,298 | B2 | 8/2012 | Wilson |
| 8,313,301 | B2 | 11/2012 | Hudson |
| 8,366,383 | B2 | 2/2013 | Thibodeau |
| 8,449,246 | B1 | 5/2013 | Liang |
| 8,459,934 | B2 | 6/2013 | Hofmann |
| 8,727,704 | B2 | 5/2014 | Lee |
| 8,814,507 | B1 | 8/2014 | Campbell |
| 8,985,940 | B2 | 3/2015 | Zhang |
| 9,028,744 | B2 | 5/2015 | Durocher |
| 9,611,754 | B2 | 4/2017 | Taylor |
| 9,677,412 | B2 | 6/2017 | Jones |
| 9,689,273 | B2 | 6/2017 | Jones |
| 9,784,125 | B2 * | 10/2017 | Duguay ..... F01D 25/12 |
| 9,920,647 | B2 | 3/2018 | Jones |
| 9,926,799 | B2 | 3/2018 | Romanov |
| 10,107,128 | B2 | 10/2018 | Romanov |
| 10,174,622 | B2 | 1/2019 | Zhang |
| 2004/0001753 | A1 | 1/2004 | Tiemann |
| 2005/0111965 | A1 | 5/2005 | Lowe |
| 2005/0214156 | A1 | 9/2005 | Troitski et al. |
| 2009/0129961 | A1 | 5/2009 | Lavoie |
| 2010/0025001 | A1 | 2/2010 | Lee et al. |
| 2011/0033331 | A1 | 2/2011 | Tuppen et al. |
| 2011/0250560 | A1 | 10/2011 | Kwon et al. |
| 2012/0186768 | A1 | 7/2012 | Sun et al. |
| 2013/0028704 | A1 | 1/2013 | Thibodeau |
| 2016/0169016 | A1 | 6/2016 | Blaney |
| 2016/0305262 | A1 * | 10/2016 | Durocher ..... F01D 9/04 |

* cited by examiner

TURBINE SHROUD COOLING

TECHNICAL FIELD

The application relates generally to turbine shrouds and, more particularly, to turbine shroud cooling.

BACKGROUND OF THE ART

Turbine shroud segments are exposed to hot gases and, thus, require cooling. Cooling air is typically bled off from the compressor section, thereby reducing the amount of energy that can be used for the primary purposed of proving trust. It is thus desirable to minimize the amount of air bleed of from other systems to perform cooling. Various methods of cooling the turbine shroud segments are currently in use and include impingement cooling through a baffle plate, convection cooling through long EDM holes and film cooling.

Although each of these methods have proven adequate in most situations, advancements in gas turbine engines have resulted in increased temperatures and more extreme operating conditions for those parts exposed to the hot gas flow.

SUMMARY

In one aspect, there is provided a turbine shroud segment for a gas turbine engine having an annular gas path extending about an engine axis, the turbine shroud segment comprising: a body having an upstream end portion and a downstream end portion relative to a flow of gases through the gas path; a core cavity defined in said body and extending axially from said upstream end portion to said downstream end portion; a plurality of cooling inlets defined in the upstream end portion of the body and in fluid flow communication with the core cavity; a plurality of cooling outlets defined in the downstream end portion of the body and in fluid flow communication with the core cavity; and a plurality of pedestals in the core cavity.

In another aspect, there is provided a casting core for forming an internal cooling circuit in a turbine shroud segment, the casting core comprising: a ceramic body having opposed top and bottom surfaces extending axially from a front end to a rear end, a transversal row of ribs formed along the front end, the ribs extending at an acute angle from the top surface towards the rear end, and a plurality of holes defined through the ceramic body, the holes having a same orientation as that of the ribs.

In a further aspect, there is provided a method of manufacturing a turbine shroud segment comprising: using a casting core to create an internal cooling circuit of the turbine shroud segment, the casting core having a body to form a core cavity in the turbine shroud segment, the body having opposed top and bottom surfaces extending axially from a front end to a rear end, a transversal row of ribs formed along the front end to define inlet passages in a front end portion of the turbine shroud segment, the ribs extending at an acute angle from the top surface towards the rear end of the casting core, and a plurality of holes defined through the body of the casting core to form pedestals in the core cavity of the turbine shroud segment, the holes having a same orientation as that of the ribs; casting a body of the turbine shroud segment about the casting core; and removing the casting core from the cast body of the turbine shroud segment.

DESCRIPTION OF THE DRAWINGS

Reference is now made to the accompanying figures in which.

DETAILED DESCRIPTION

Figure 1:
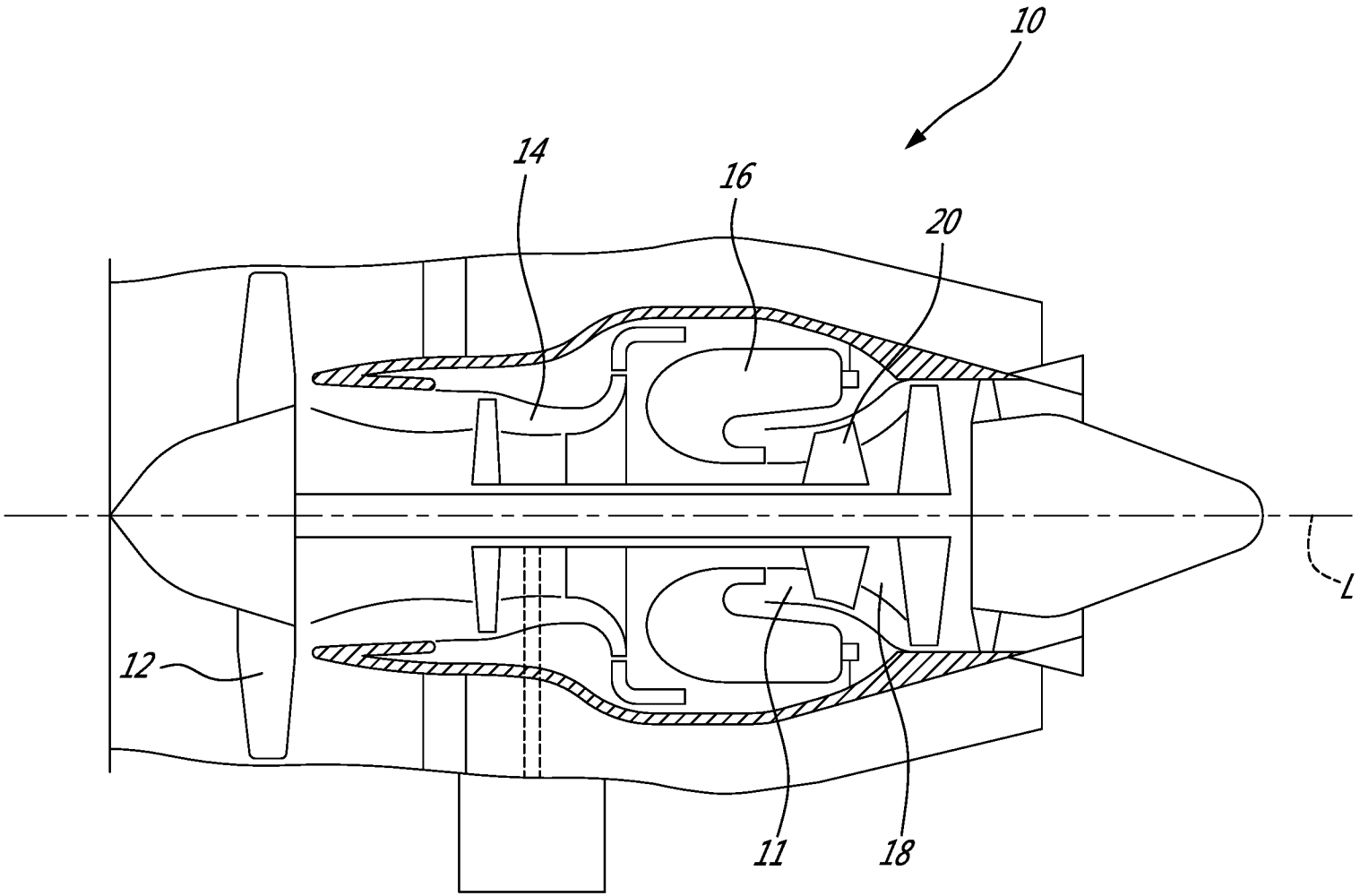
FIG. 1 is a schematic cross-sectional view of a gas turbine engine.

FIG. 1 illustrates a gas turbine engine 10 of a type preferably provided for use in subsonic flight, generally comprising an annular gas path 11 disposed about an engine axis L. A fan 12, a compressor 14, a combustor 16 and a turbine 18 are axially spaced in serial flow communication along the gas path 11. More particularly, the engine 10 comprises a fan 12 through which ambient air is propelled, a compressor section 14 for pressurizing the air, a combustor 16 in which the compressed air is mixed with fuel and ignited for generating an annular stream of hot combustion gases, and a turbine 18 for extracting energy from the combustion gases.

Figure 2:
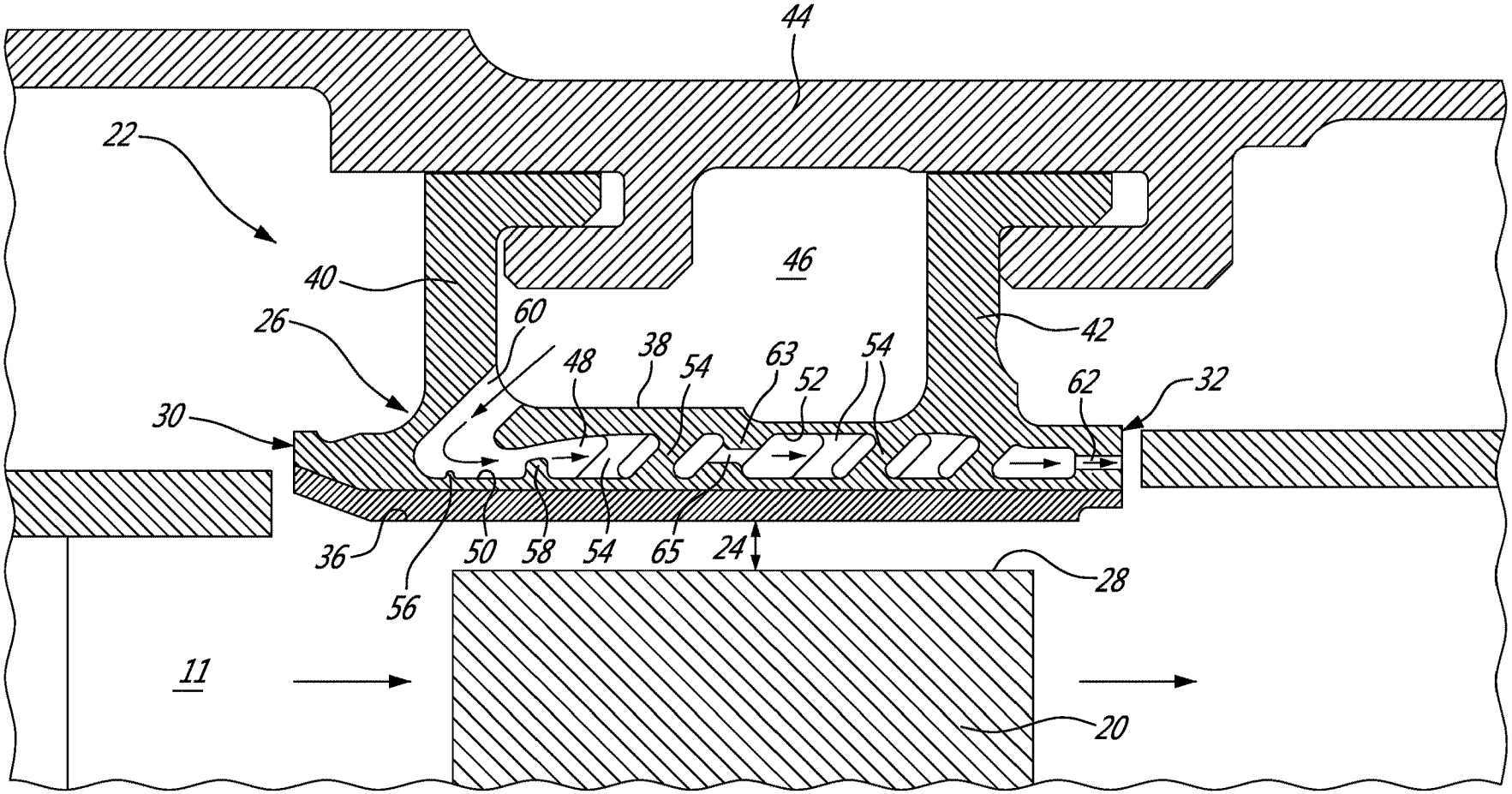
FIG. 2 is a schematic cross-section of a turbine shroud segment mounted radially outwardly in close proximity to the tip of a row of turbine blades of a turbine rotor.

As shown in FIG. 2, the turbine 18 includes turbine blades 20 mounted for rotation about the axis L. A turbine shroud 22 extends circumferentially about the rotating blades 20. The shroud 22 is disposed in close radial proximity to the tips 28 of the blades 20 and defines therewith a blade tip clearance 24. The shroud includes a plurality of arcuate segments 26 spaced circumferentially to provide an outer flow boundary surface of the gas path 11 around the blade tips 28.

Figure 3:
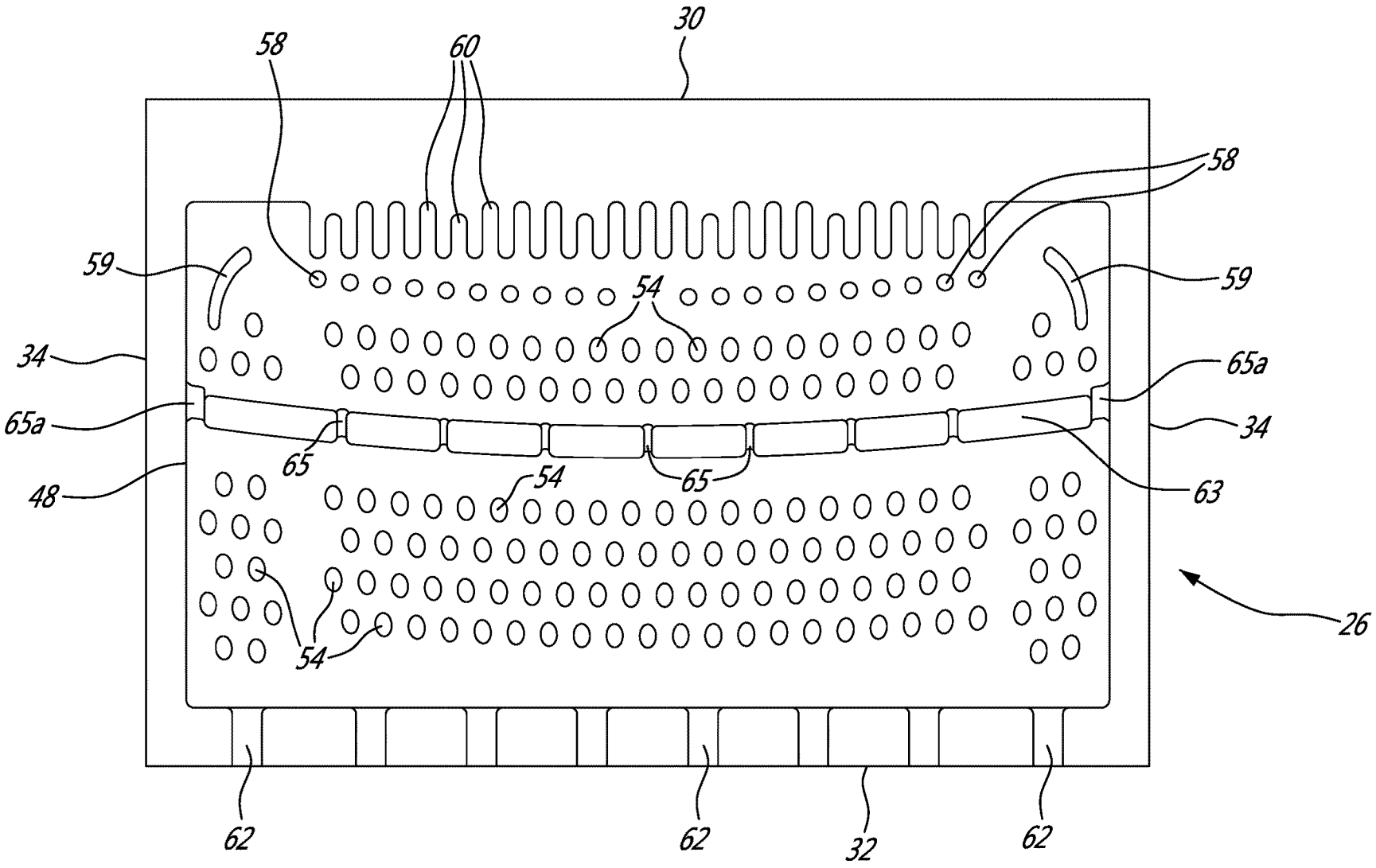
FIG. 3 is a plan view of a cooling scheme of the turbine shroud segment shown in FIG. 2.

Each shroud segment 26 has a monolithic cast body extending axially from a leading edge 30 to a trailing edge 32 and circumferentially between opposed axially extending sides 34 (FIG. 3). The body has a radially inner surface 36 (i.e. the hot side exposed to hot combustion gases) and a radially outer surface 38 (i.e. the cold side) relative to the engine axis L. Front and rear support legs 40, 42 (e.g. hooks) extend from the radially outer surface 38 to hold the shroud segment 26 into a surrounding fixed structure 44 of the engine 10. A cooling plenum 46 is defined between the front and rear support legs 40, 42 and the structure 44 of the engine 10 supporting the shroud segments 44. The cooling plenum 46 is connected in fluid flow communication to a source of coolant. The coolant can be provided from any suitable source but is typically provided in the form of bleed air from one of the compressor stages.

According to the embodiment illustrated in FIGS. 2 and 3, each shroud segment 26 has a single internal cooling scheme integrally formed in its body for directing a flow of coolant from a front or upstream end portion of the body of the shroud segment 26 to a rear or downstream end portion thereof. This allows to take full benefit of the pressure delta between the leading edge 30 (front end) and the trailing edge (the rear end). The cooling scheme comprises a core cavity 48 (i.e. a cooling cavity formed by a sacrificial core) extending axially from the front end portion of the body to the rear end portion thereof. In the illustrated embodiment, the core cavity 48 extends axially from underneath the front support leg 40 to a location downstream of the rear support leg 42 adjacent to the trailing edge. It is understood that the core cavity 48 could extend forwardly of the front support leg 40 towards the leading edge 30 of the shroud segment 26. In the circumferential direction, the core cavity 48 extends from a location adjacent a first lateral side 34 of the shroud segment 26 to a location adjacent the second opposed lateral side 34 thereof, thereby spanning almost the entire circumferential extent of the body of the shroud segment 26. The core cavity 48 has a bottom surface 50 which corresponds to the back side of the radially inner surface 36 (the hot surface) of the shroud body and a top surface 52 corresponding to the inwardly facing side of the radially outer surface 38 (the cold surface) of the shroud body. The bottom and top surfaces 50, 52 of the core cavity 48 are integrally cast with the body of the shroud segment 26. The core cavity 48 is, thus, bounded by a monolithic body.

As shown in FIGS. 2 and 3, the core cavity 48 includes a plurality of pedestals 54 extending radially from the bottom wall 50 of the core cavity 48 to the top wall 52 thereof. As shown in FIG. 3, the pedestals 54 can be distributed in transversal rows with the pedestals 54 of adjacent rows being laterally staggered to create a tortuous path. The pedestals 54 are configured to disrupt the coolant flow through the core cavity 48 and, thus, increase heat absorption capacity. In addition to promoting turbulence to increase the heat transfer coefficient, the pedestals 54 increase the surface area capable to transferring heat from the hot side 36 of the turbine shroud segment 26, thereby proving more efficient and effective cooling. Accordingly, the cooling flow as the potential of being reduced. It is understood that the pedestals 54 can have different cross-sectional shapes. For instance, the pedestals 54 could be circular or oval in cross-section. The pedestals 54 are generally uniformly distributed over the surface the area of the core cavity 48. However, it is understood that the density of pedestals could vary over the surface area of the core cavity 48 to provide different heat transfer coefficients in different areas of the turbine shroud segment 26. In this way, additional cooling could be tailored to most thermally solicited areas of the shroud segments 26, using one simple cooling scheme from the front end portion to the rear end portion of the shroud segment 26. In use, this provides for a more uniform temperature distribution across the shroud segments 26.

As can be appreciated from FIG. 2, other types of turbulators can be provided in the core cavity 48. For instance, a row of trip strips 56 can be disposed upstream of the pedestals 54. It is also contemplated to provide a transversal row of stand-offs 58 between the trip strips 56 and the first row of pedestals 54. In fact, various combinations of turbulators are contemplated.

The cooling scheme further comprises a plurality of cooling inlets 60 for directing coolant from the plenum 46 into a front or upstream end of the core cavity 48. According to the illustrated embodiment, the cooling inlets 60 are provided as a transverse row of inlet passages along the front support leg 40. The inlet passages have an inlet end opening on the cooling plenum 46 just downstream (rearwardly) of the front support leg 40 and an outlet end opening to the core cavity 48 underneath the front support leg 40. As can be appreciated from FIG. 2, each inlet passage is angled forwardly to direct the coolant towards the front end portion of the shroud segment 26. That is each inlet passage is inclined to define a feed direction having an axial component pointing in an upstream direction relative to the flow of gases through the gas path 11. The angle of inclination of the cooling inlets 60 is an acute angle as measured from the radially outer surface 38 of the shroud segment 26. According to the illustrated embodiment, the inlets 60 are angled at about 45 degrees from the radially outer surface 38 of the shroud segment 26. If the inlet passages are formed by casting (they could also be drilled), the pedestals 54 may be configured to have the same orientation, including the same angle of inclination, as that of the as-cast inlet passages in order to facilitate the core de-molding operations. This can be appreciated from FIG. 2 wherein both the inlet passages and the pedestals are inclined at about 45 degrees relative to the bottom and top surfaces 50, 52 of the core cavity 48. As the combined cross-sectional area of the inlets 60 is small relative to that of the plenum 46, the coolant is conveniently accelerated as it is fed into the core cavity 48. The momentum gained by the coolant as it flows through the inlet passages contribute to provide enhance cooling at the front end portion of the shroud segment 26.

The cooling scheme further comprises a plurality of cooling outlets 62 for discharging coolant from the cavity core 48. As shown in FIG. 3, the plurality of outlets 62 includes a row of outlet passages distributed along the trailing edge 32 of the shroud segment 26. The trailing edge outlets 62 may be cast or drilled. They are sized to meter the flow of coolant discharged through the trailing edge 32 of the shroud segment 26. The cooling outlets 62 may comprise additional as-cast or drilled outlet passages. For instance, cooling passages (not shown) could be defined in the lateral sides 34 of the shroud body to purge hot combustion gases from between circumferentially adjacent shroud segments 26 or in the radially inner surface 36 of the shroud body to provide for the formation of a cooling film over the radially inner surface 36 of the shroud segments 26.

Referring to FIG. 3, it can be appreciated that the cooling scheme may also comprise a pair of turning vanes 59 in opposed front corners of the cooling cavity 48. The turning vanes are disposed immediately downstream of the inlets 60 and configured to redirect a portion of the coolant flow discharged by the inlets 60 along the lateral sides 34 of the shroud body.

Now referring concurrently to FIGS. 2 and 3, it can be appreciated that the cooling scheme may further comprise a cross-over wall 63 in the upstream half or front half of the core cavity 48. A plurality of laterally spaced-part cross-over holes 65 are defined in the cross-over wall 63 to meter the flow of coolant delivered into the downstream or rear half of the core cavity 48. It is understood that the cross area of the cross-over holes 65 is less than that of the inlets 60 to provide the desired metering function. It can also be appreciated from FIG. 3, that the cross-over holes 65 comprises two lateral cross-over holes **65*a* along respective lateral sides of the core cavity 48 and that these lateral holes 65*a* have a greater cross-section than that of the other cross-over holes 65. In this way, more coolant can flow adjacent the lateral sides 34 of the shroud segment 26. This provides additional cooling along the lateral sides which have been found to be more thermally solicited than other regions of the shroud segment 26**. In this way, a more uniform temperature distribution can be maintained over the entire surface of the shroud segment.

The cooling scheme thus provides for a simple front-to-rear flow pattern according to which a flow of coolant flows front a front end portion to a rear end portion of the shroud segment 26 via a core cavity 48 including a plurality of turbulators (e.g. pedestals) to promote flow turbulence between a transverse row of inlets 60 provided at the front end portion of shroud body and a transverse row of outlets 62 provided at the rear end portion of the shroud body. In this way, a single cooling scheme can be used to effectively cool the entire shroud segment.

The shroud segments 26 may be cast via an investment casting process. In an exemplary casting process, a ceramic core C (see FIG. 4) is used to form the cooling cavity 48 (including the trip strips 56, the stand-offs 58 and the pedestals 54), the cooling inlets 60 as well as the cooling outlets 62. The core C is over-molded with a material forming the body of the shroud segment 26. That is the shroud segment 26 is cast around the ceramic core C. Once, the material has formed around the core C, the core C is removed from the shroud segment 26 to provide the desired internal configuration of the shroud cooling scheme. The ceramic core C may be leached out by any suitable technique including chemical and heat treatment techniques. As should be appreciated, many different construction and molding techniques for forming the shroud segments are contemplated. For instance, the cooling inlets 60 and outlets 62 could be drilled as opposed of being formed as part of the casting process. Also some of the inlets 60 and outlets 62 could be drilled while others could be created by corresponding forming structures on the ceramic core C. Various combinations are contemplated.

Figure 4:
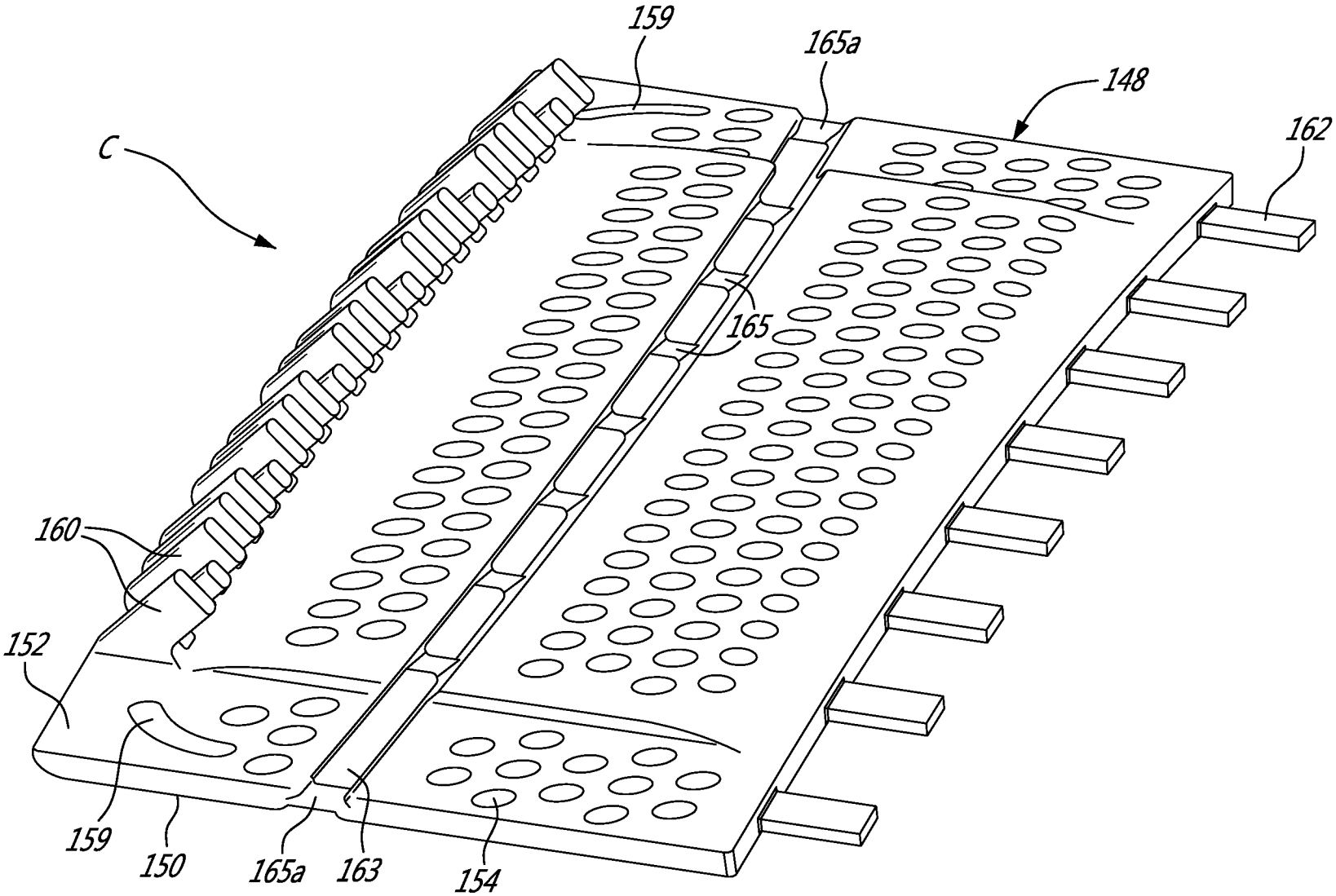
FIG. 4 is an isometric view of a casting core used to create the internal cooling scheme of the turbine shroud segment.

FIG. 4 shows an exemplary ceramic core C that could be used to form the core cavity 48 as well as as-cast inlet and outlet passages. The use of the ceramic core C to form at least part of the cooling scheme provides for better cooling efficiency. It may thus result in cooling flow savings. It can also result in cost reductions in that the drilling of long EDM holes and aluminide coating of the holes are no longer required.

It should be appreciated that FIG. 4 actually shows a "mirror" of the cooling circuit of FIGS. 2 and 3. Notably, FIG. 4 includes reference numerals that are identical to those in FIGS. 2 and 3 but in the hundred even though what is actually shown in FIG. 4 is the casting core C rather than the actual internal cooling scheme. More particularly, the ceramic core C has a body 148 having opposed bottom and top surfaces 150, 152 extending axially from a front end to a rear end. The body 148 is configured to create the internal core cavity 48 in the shroud segment 26. A front transversal row of ribs 160 is formed along the front end of the ceramic core C. The ribs 160 extend at an acute angle from the top surface 152 of the ceramic core C towards the rear end thereof, thereby allowing for the creation of as-cast inclined inlet passages in the front end portion of the shroud segment 26. Slanted holes 154 are defined through the ceramic body 148 to allow for the creation of pedestals 154. Likewise recesses (not shown) are defined in the core body 148 to provide for the formation of the trip strips 56 and the stand-offs 58. The pedestal holes 154 have the same orientation as that of the ribs 160 to simplify the core die used to form the core itself. It facilitates de-moulding of the core and reduces the risk of breakage. According to one embodiment, the ribs 160 and the holes 154 are inclined at about 45 degrees from the top surface 152 of the ceramic body 148. The casting core C further comprises a row of projections 162, such as pins, extending axially rearwardly along the rear end of the ceramic body 148 between the bottom and top surfaces 150, 152 thereof. These projections 162 are configured to create as-cast outlet metering holes 62 in the trailing edge 32 of the shroud segment 26.

The core C also comprises features 159, 163, 165 to respectively form the turning vanes 59, the cross-over wall 63 and the cross-over holes 65. It can be appreciated that the lateral cross-over pins 165*a* are larger than the inboard cross-over pins 165.

The above description is meant to be exemplary only, and one skilled in the art will recognize that changes may be made to the embodiments described without departing from the scope of the invention disclosed. Any modifications which fall within the scope of the present invention will be apparent to those skilled in the art, in light of a review of this disclosure, and such modifications are intended to fall within the appended claims.

The invention claimed is:

1. A turbine shroud segment for a gas turbine engine having an annular gas path extending about an engine axis, the turbine shroud segment comprising: a body having an upstream end portion and a downstream end portion relative to a flow of gases through the gas path; a core cavity defined in said body and extending axially from said upstream end portion to said downstream end portion; a plurality of cooling inlets defined in the upstream end portion of the body and in fluid flow communication with the core cavity; a plurality of cooling outlets defined in the downstream end portion of the body and in fluid flow communication with the core cavity; and a plurality of pedestals in the core cavity, wherein the plurality cooling inlets and the plurality of pedestals are angled at a same angle of inclination.

2. The turbine shroud segment defined in claim 1, wherein the plurality of cooling inlets defines a feed direction having an axial component pointing in an upstream direction relative to the flow of gases through the gas path.

3. The turbine shroud segment defined in claim 1, wherein said downstream end includes a trailing edge of the body of the turbine shroud segment, and wherein at least some of said plurality of cooling outlets are distributed along said trailing edge.

4. The turbine shroud segment defined in claim 1, wherein the turbine shroud segment has a single cooling circuit between the upstream end portion and the downstream end portion of the body.

5. The turbine shroud segment defined in claim 1, wherein the plurality of cooling inlets are in fluid flow communication with a common source of coolant on a radially outer side of the body of the turbine shroud segment relative to the engine axis, and wherein the plurality of cooling inlets are configured to accelerate and direct the coolant in a forwardly radially inwardly inclined direction.

6. A casting core for forming an internal cooling circuit in a turbine shroud segment, the casting core comprising: a ceramic body having opposed top and bottom surfaces extending axially from a front end to a rear end, a transversal row of ribs formed along the front end, the ribs extending at an acute angle from the top surface towards the rear end, and a plurality of holes defined through the ceramic body, the holes having a same orientation as that of the ribs.

7. The casting core defined in claim 6, further comprising a row of projections extending axially rearwardly along the rear end of the ceramic body between the top and bottom surfaces thereof.

8. The casting core defined in claim 6, wherein the ribs and the holes are inclined at about 45 degrees from the top surface of the ceramic body.

9. The casting core defined in claim 7, wherein the holes extend through the top and bottom surfaces and are disposed axially between the transversal row of ribs and the row of projections.

10. The casting core defined in claim 7, wherein the number of projections extending from the rear end is less than the number of ribs formed at the front end of the ceramic body.

11. A method of manufacturing a turbine shroud segment comprising: using a casting core to create an internal cooling circuit of the turbine shroud segment, the casting core having a body to form a core cavity in the turbine shroud segment, the body having opposed top and bottom surfaces extending axially from a front end to a rear end, a transversal row of ribs formed along the front end to define inlet passages in a front end portion of the turbine shroud segment, the ribs extending at an acute angle from the top surface towards the rear end of the casting core, and a plurality of holes defined through the body of the casting core to form pedestals in the core cavity of the turbine shroud segment, the holes having a same orientation as that of the ribs; casting a body of the turbine shroud segment about the casting core; and removing the casting core from the cast body of the turbine shroud segment.

12. The method defined in claim 11, further comprising using the casting core to form as-cast outlet passages in a trailing edge of the turbine shroud segment.

* * * * *